United States Patent [19]

Chandler

[11] Patent Number: 4,722,110

[45] Date of Patent: Feb. 2, 1988

[54] CLEANING APPARATUS FOR A LIQUID CONTAINING VESSEL

[75] Inventor: Michael J. Chandler, Auckland, New Zealand

[73] Assignee: Trucklock Products Limited, Auckland, New Zealand

[21] Appl. No.: 880,589

[22] Filed: Jun. 30, 1986

[30] Foreign Application Priority Data

Jun. 28, 1985 [NZ] New Zealand ..... 212590

[51] Int. Cl.[4] ..... E04H 3/20

[52] U.S. Cl. ..... 15/1.7

[58] Field of Search ..... 15/1.7; 210/169

[56] References Cited

U.S. PATENT DOCUMENTS

| | | | |
|---|---|---|---|
| 3,229,315 | 1/1966 | Watson | 15/1.7 |
| 3,979,788 | 9/1976 | Strausak | 15/1.7 |
| 4,449,265 | 5/1984 | Hoy | 15/1.7 |
| 4,560,418 | 12/1985 | Raubenheimer | 15/1.7 |

*Primary Examiner*—Edward L. Roberts

*Attorney, Agent, or Firm*—Holman & Stern

[57] ABSTRACT

Apparatus is provided for cleaning the walls of liquid containing vessels, particularly swimming pools. The apparatus is powered by suction applied to an outlet. The outlet communicates with two inlets, a first inlet being positioned adjacent the vessel surface while a second inlet is aligned toward the interior of the vessel. Motive means, preferably in the form of an axial flow turbine, is situated between the second inlet and the outlet to effect operation and mobility means preferably in the form of a pair of wheels.

19 Claims, 9 Drawing Figures

CLEANING APPARATUS FOR A LIQUID CONTAINING VESSEL

This invention relates to cleaning apparatus for a liquid containing vessel and has been developed particularly to provide apparatus for cleaning the interior surfaces of swimming pools, it being appreciated that the term 'vessel' as used herein is intended to include pool and tank within its scope.

It is an object of the present invention to provide cleaning apparatus for cleaning a liquid containing vessel which will at least provide the public with a useful choice.

Accordingly the invention consists in cleaning apparatus for cleaning the interior surface of a liquid containing vessel, said apparatus including a chassis; mobility means extending from said chassis to support said chassis on said interior surface, said mobility means being operable to effect movement of said chassis over said interior surface; a liquid outlet associated with said chassis and attachable to the suction side of a liquid pump; a first inlet associated with said chassis, said first inlet being positioned such that, when said apparatus is in its normal operative position on said mobility means, said first inlet lies closely adjacent said interior surface; a second inlet, said first and second inlets being in communication with said outlet; and motive means mounted between said second inlet and said outlet, said motive means being actuated by liquid flow between said second inlet and said outlet and being operable to actuate said mobility means.

The mobility means typically comprises a plurality of wheels. In particular we have found that three wheels are suitable for supporting the apparatus as described herein, the three wheels comprising a pair of spaced drive wheels mounted, on a common axis, on either side of the chassis and a nose wheel mounted midway between, and ahead of, the main drive wheels.

The apparatus may further be provided with guide means to guide the leading edge of the apparatus upwardly when the apparatus encounters an upwardly extending surface, such as a vertical pool wall, during substantially horizontal movement. This guide means preferably comprises or includes a further wheel mounted above, and just ahead of, the nose wheel so that the nose wheel, and then the drive wheels, are brought into contact with the upwardly extending surface.

The first inlet is preferably provided in the base of the chassis which is preferably substantially planar in form. The second inlet is preferably provided in the upper surface of the chassis and is preferably aligned in a directly opposite sense to the first inlet. A grill is preferably provided over the second inlet to prevent the ingress of leaves and other larger debris through the second inlet, it being intended that such debris be drawn directly off the surfaces being cleaned through the first inlet.

In order to maintain an effective vacuum about the first inlet, the aperture defining the first inlet is preferably surrounded by suitable sliding sealing means. Typically such sealing means comprise brushes and/or flexible sliding rubber seals which engage the surface over which the apparatus passes. The brushes are preferably spring biassed down into contact with the surface over which the apparatus passes.

The operating motive power is preferably provided by the filter pump of a domestic swimming pool. The suction side of the pump is connected to the outlet, preferably by a flexible hose, so as to draw water through both the first and the second inlets. The motive means provided between the second inlet and the outlet is preferably a turbine of the axial flow type and more particularly a Kaplan turbine. The drive from this turbine is preferably passed through a suitable transmission before being applied to a main drive shaft which, in turn, rotates the main drive wheels. The transmission reduces the speed of rotation to a suitable degree. Typically the operating speed of the turbine is somewhere in the order of 2,500 to 3,500, rpm. This speed of rotation is preferably reduced about 20:1 at the drive shaft and there is a further speed reduction between the drive shaft and the main drive wheels.

The main drive shaft includes drive surfaces, in the form of gears or frictional drive members, at either end thereof, these drive surfaces engaging compatible planetary surfaces provided on the inner sides of the drive wheels.

Obviously the speed of the turbine largely depends on the flow rate induced by the filter pump however suitable throttling means are preferably provided to control the amount of water passing through the second inlet and thus through the turbine. This throttling means preferably comprises a shroud member whose position can be adjusted to partially cover the second inlet or at least partially restrict the flow of water to the turbine.

Reversing means are also preferably provided to intermittently reverse one of the drive wheels so as to change the direction of travel of the apparatus. This reversing means preferably includes a further reduction gear train operating a reverse actuating mechanism. The reverse actuating mechanism preferably operates to displace the drive surface on one end of the main drive shaft into contact with a second planetary surface provided on the corresponding drive wheel, the second planetary surface being on the opposite side of the drive shaft axis to that through which forward motion is achieved. Thus, since the direction of rotation of the drive shaft is constant, displacement of one end hereof into contact with the second planetary surface obviously causes reversal of the direction of rotation of that wheel. The reversing means is preferably adjustable so that the time delay between reversing increments can be varied. This is preferably achieved by including a plurality of cam surfaces as part of the reverse actuating mechanism and providing a cam follower which can be selectively positioned to engage one or both of the cam surfaces.

The outlet is preferably included in a pivotal coupling which is preferably mounted to pivot about the same axis as the axis about which the main drive wheels rotate. This ensures that any restraining forces applied through the hose connected to the outlet effects the motion and stability of the apparatus only minimally. A slot is provided in the underside of the coupling to place the interior of the coupling in communication with the first inlet in the base of the chassis. The coupling is preferably axially aligned with the turbine axis and one end is pivotally engaged with the turbine housing to receive liquid flow therefrom.

As a further feature the cleaning apparatus according to the invention preferably further includes control means to control the displacement of the apparatus up upwardly extending surfaces and, more particularly, prevent the apparatus being displaced above the liquid level to an extent as would allow air to be drawn in through either inlet.

The control means preferably comprise a pair of laterally extending cylindrical members mounted coaxially with the upper guide wheel, each of the cylindrical members being sealed to generate bouyancy when immersed in water. A static mass is further provided, the mass serving to generate a gravitational force equal to the bouyancy generated when immersed in water. Thus, while the cylindrical members are immersed they have no effect but as they are displaced out of the water the bouyancy forces disappear and the static mass generates an overall gravitational force which causes the apparatus to pivot, about the drive wheels, off the upwardly extending wall surface and fall back into the body of liquid. Hemispherical rotating elements are preferably provided on the distal ends of the cylindrical members to stop the apparatus becoming jammed in the event the apparatus is displaced so that an end of one of the cylindrical members becomes engaged in a reentrant corner of the vessel.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One particular embodiment of apparatus according to the invention will now be described with reference to the accompanying drawings in which.

Figure 1:
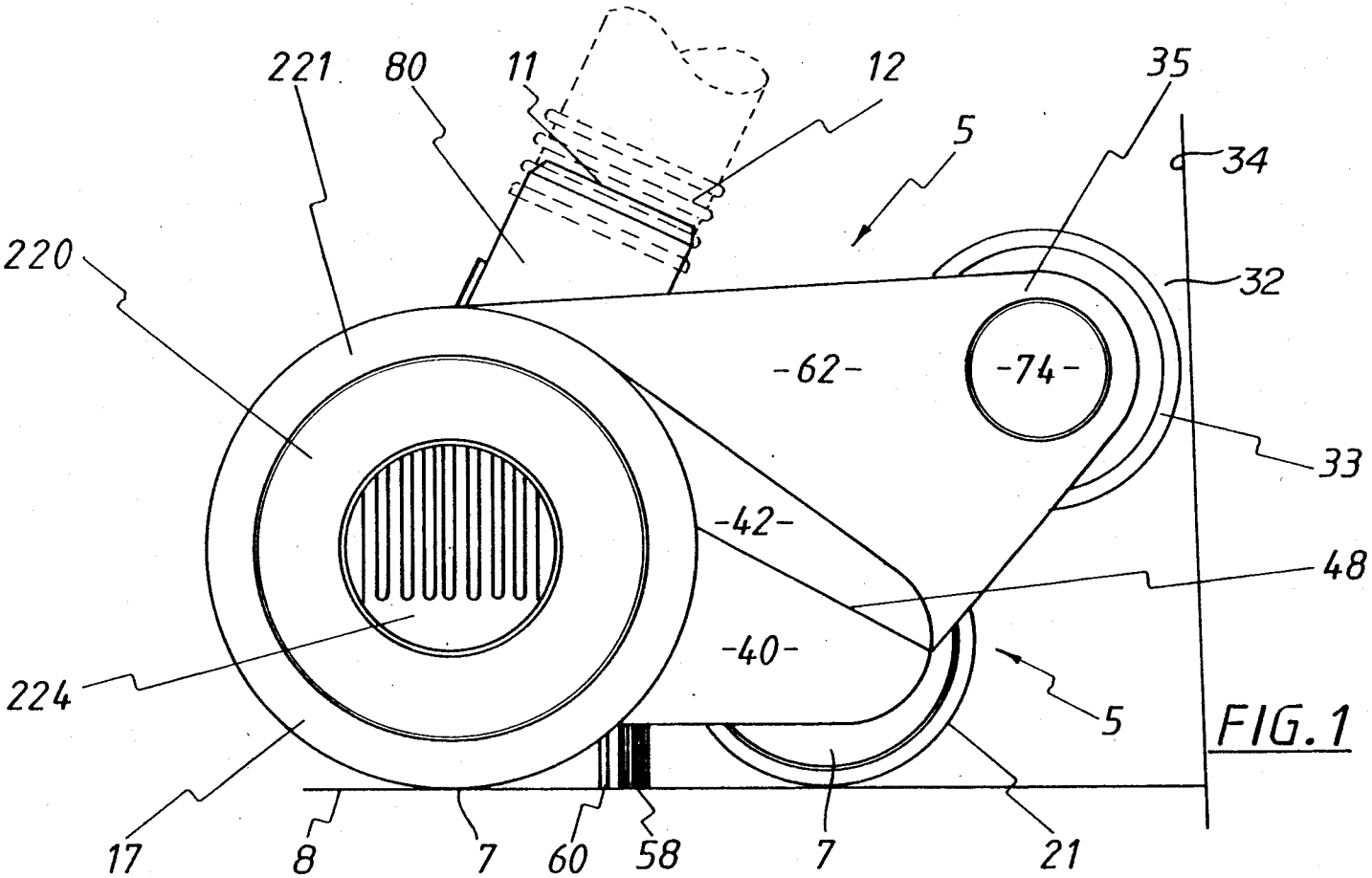
FIG. 1 shows a side elevational view of cleaning apparatus according to the invention.

Referring to the drawings, according to the invention, cleaning apparatus 5 is provided for cleaning the interior surfaces of a liquid containing vessel. The embodiment depicted and herein described has been developed particularly for cleaning he interior surfaces of swimming pools although it will be appreciated, by those skilled in the art, that the principle incorporated in the present invention could be applied to apparatus for cleaning the interior surfaces of any liquid containing vessel.

As shown, the apparatus 5 includes a chassis 6 and mobility means 7 which support the chassis 6 and, upon actuation, effect displacement of the apparatus over the interior surface 8 of a liquid containing vessel such as a swimming pool. A first liquid inlet 9 is provided in a surface of the body which, when the apparatus is in its normal configuration during use, lies adjacent the surface 8. A second liquid inlet 10 is provided in a position spaced from the first inlet 9, both inlets 9 and 10 being in liquid communication with a single liquid outlet 11. In use, the outlet 11 is placed in communication with the suction side of liquid pump (not shown) by, for example, a flexible hose 12 (FIG. 1) so that upon operation of the pump, liquid from the interior of the vessel is drawn in through inlets 9 and 10.

Mounted between the second inlet 10 and the outlet 11 is motive means 13 which is operated by fluid flow generated between the inlet 10 and the outlet 11. We have found that sufficiently high power outputs can be achieved from modest liquid flow rates when the motive means is a turbine of the axial flow type, particularly that of the Kaplan type.

The mobility means 7 preferably comprise a plurality of wheels and, more particularly, a pair of main drive wheels 15 and 17 which are mounted on a common axis 19, and a third, nose wheel 21. As can be seen the nose wheel is mounted midway between, and ahead of the wheels 15 and 17.

The main drive wheels 15 and 17 are mounted on either side of the chassis 6 on dead axles 23 projecting from the chassis, bearings 25 being interposed between the axles 23 and the wheels.

A main drive shaft 27 mounted within the chassis extends between the wheels 15 and 17 to simultaneously impart drive thereto, the drive shaft being rotated by turbine 13 through a step-down transmission 29.

Reversing means 31 are, as shown, provided to intermittently effect reverse rotation of main drive wheel 17.

The apparatus preferably includes guide means 32 to guide the chassis 6 from a situation of horizontal movement into operative engagement with a surface 34 extending upwardly from horizontal surface 8 when engaged thereby. As can be seen the guide means 32 includes a further wheel 33 which is mounted above and ahead of the nose wheel 21.

Still further the apparatus preferably includes control means 35 which is operable to prevent the apparatus from travelling up upwardly extending wall surfaces to such an extent that either inlet 9 or 10 rise above the water surface allowing air to be drawn therethrough.

Figure 5:
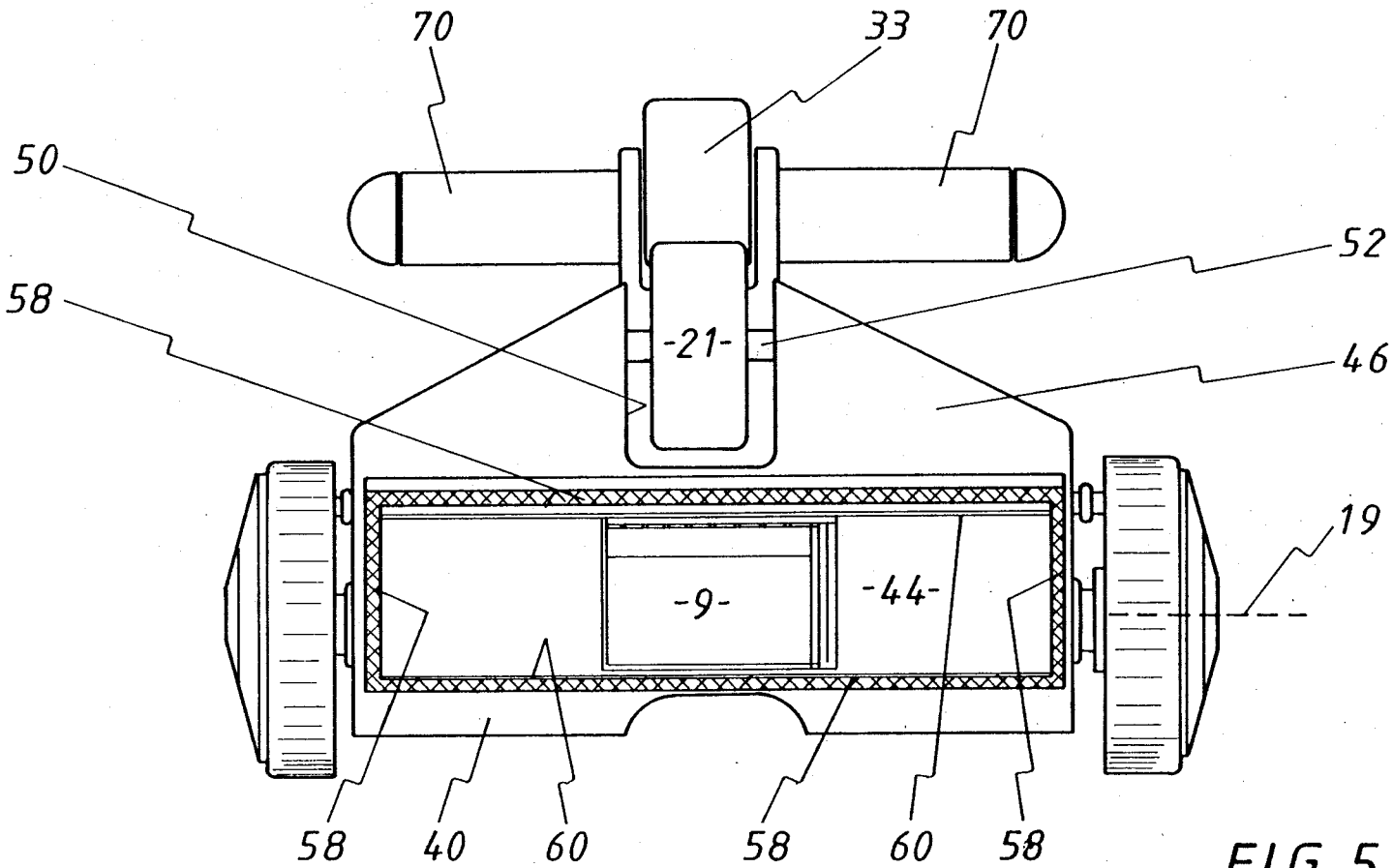
FIG. 5 shows an underside view of the apparatus shown in FIGS. 1 to 4.

In the form shown the chassis 6 comprises a base 40 and a top cover 42 which are preferably plastics mouldings and which combine together to define a housing. The under surface 44 (FIG. 5) of the base is substantially planar and, as can be seen, the first inlet 9 comprises a substantially rectangular aperture included substantially centrally in surface 44.

The leading edge 46 of the base 40 curves upwardly to joint line 48 between the base 40 and the top cover 42. When viewed in plan (as in FIG. 5) the leading edge 46 extends forwardly from either side of the chassis to give the forward edge of the base an overall triangular form however the central part of the leading edge is defined by a slot or recess 50 in which nose wheel 21 is mounted. The nose wheel has pins 52 extending from either side thereof and on the axis thereof to engage in mounting apertures, defined between the chassis halves (not shown).

Suitable means are preferably provided about the inlet aperture 9 to enhance the suction ability of the apparatus. In the form shown, such means comprise brushes which are mounted in a rectangule on the undersurface 44 and project downwardly from the surface 44 to engage the surface across which the apparatus is displaced. The laterally extending brushes may be backed by sliding rubber seals 60. The brushes are preferably slidably mounted in the chassis base 40 and are preferably spring biassed vertically downwardly. It will be appreciated that the brushes 58 also serve to loosen leaves, dirt and other debris from the surface over which, in use, the apparatus passes.

Figure 2:
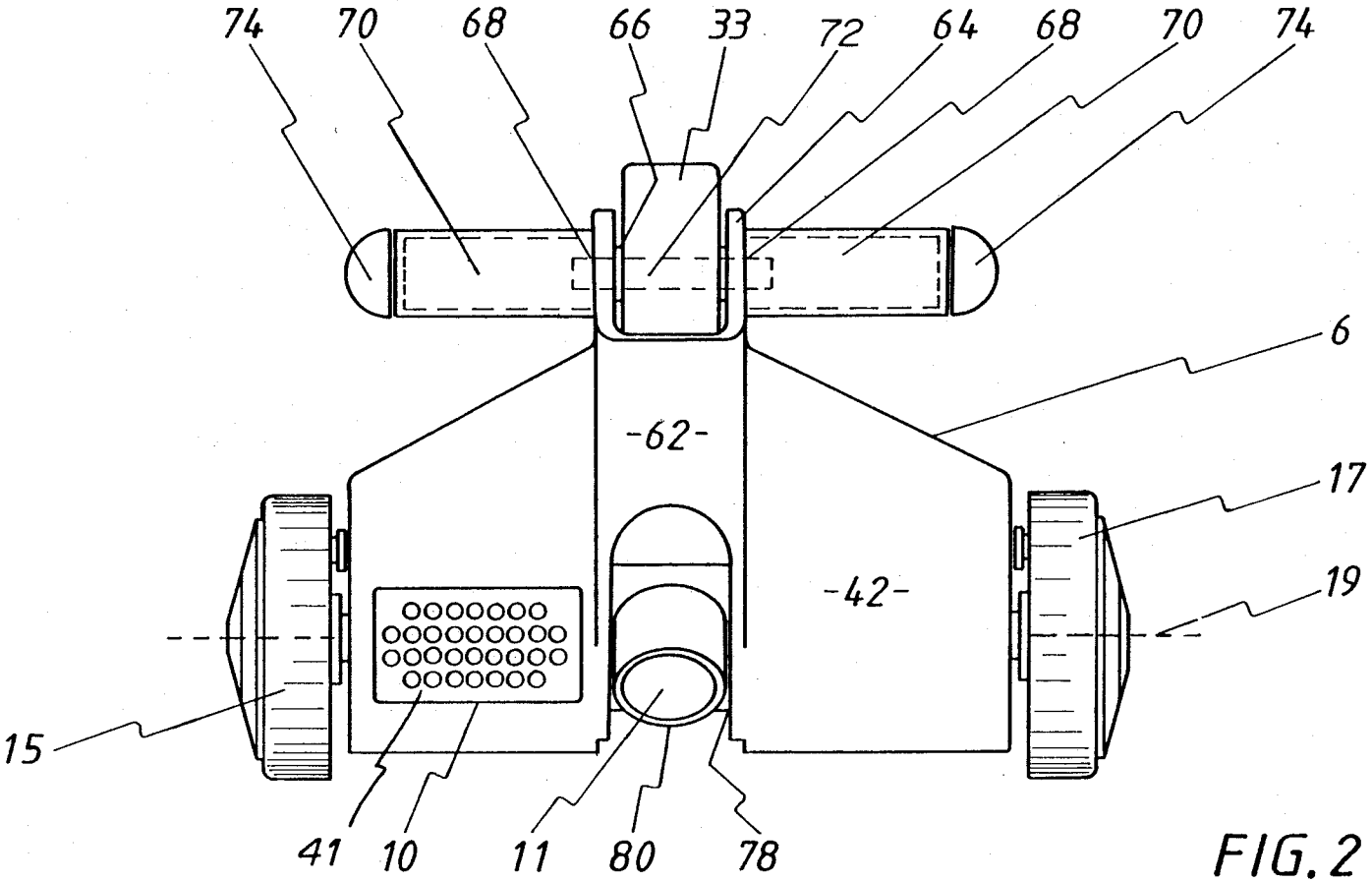
FIG. 2 shows a top plan view of the apparatus shown in FIG. 1.
Figure 3:
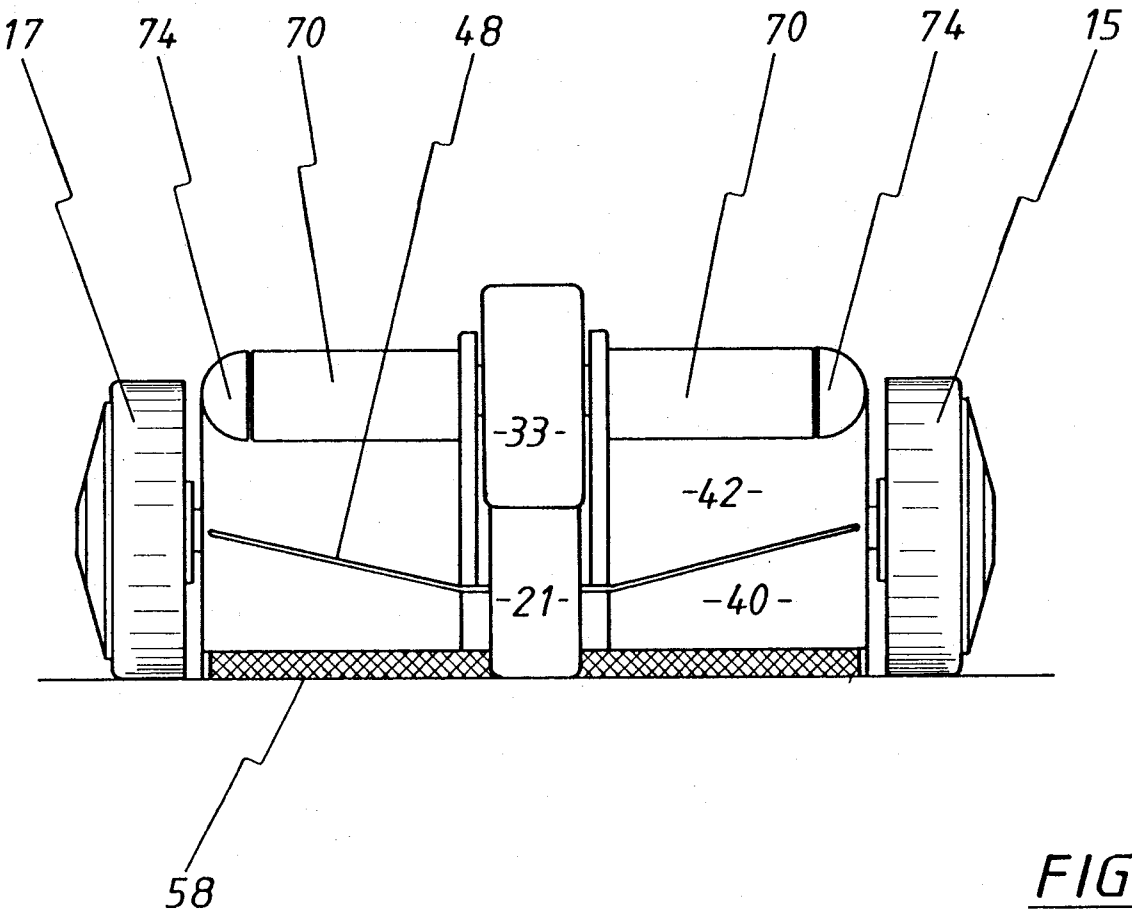
FIG. 3 shows a frontal view of the apparatus shown in FIGS. 1 and 2.

Turning now to FIG. 2 the top cover 42 is of broadly the same overall form as the base 40, when viewed in plan, the second inlet 10 being defined or covered by grill 41 thereon. It will be noted that grill 41 is mounted in a plane substantially parallel to the underside 44 of base 40 but is aligned in the opposite sense. The cover 42 includes a central, forwardly and upwardly extending section 62 terminating in a forked recess 64 in which guide wheel 33 is mounted by way of hub 66 which projects from both sides of wheel 33. The outer side surfaces 68 of that part of central section 62 defining forked recess 64 are substantially vertical and serve to mount control means 35.

In the embodiment depicted the control means 35 comprise a pair of laterally extending cylindrical members 70 which are both mounted on the axis of shaft 66. Both of the members 70 are hollow and sealed and thus, when immersed in water, both generate a bouyancy force. Located centrally between the members 70 and extending through hub 66 is a fixed mass 72 which is sized to generate a gravitational force equivalent to the bouyancy forces generated by the corresponding members 70, when immersed. Thus, when the apparatus is fully submerged, the control means 35 is inoperative. When, however, the apparatus travels up a vertical wall surface and one or both of the members 70, situated at or immediately adjacent the front of the apparatus, are displaced above the surface of the liquid contained in the vessel the bouyancy forces disappear and gravitational force thus come into play. This gravitational force generates a moment about the main wheel axis 19 sufficient to cause the apparatus to pivot, about axis 19, away from the vertical wall, peel off the wall, and fall back into the body of water.

Hemispherical bearing elements 74 are preferably rotatably mounted on the outer ends of the members 70 to minimize the possibility of the apparatus becoming jammed through one of the members 70 engaging in a re-entrant corner in the vessel.

Further bouyancy (not shown) is preferably provided on the inside surface of the top cover vertically above (or approximately so) the axis 19 to create a torque which counters the moment due to the mass of the guide wheel 33 about axis 19 when the apparatus is moving up a vertical wall. In the absence of such bouyancy the counter torque tends to peel the apparatus off the wall. The bouyancy may be of any suitable form but preferably comprises flotation material such as closed cell foam.

The rear part of central section 62 includes a further recess or slot 78 through which a fitting 80, including the outlet aperture 11, projects. As will be described in greater detail hereinafter, the fitting 80 preferably pivots about axis 19 and thus slot 78 extends forward a sufficient amount to permit a reasonable range of pivotal movement of fitting 80.

Figure 6:
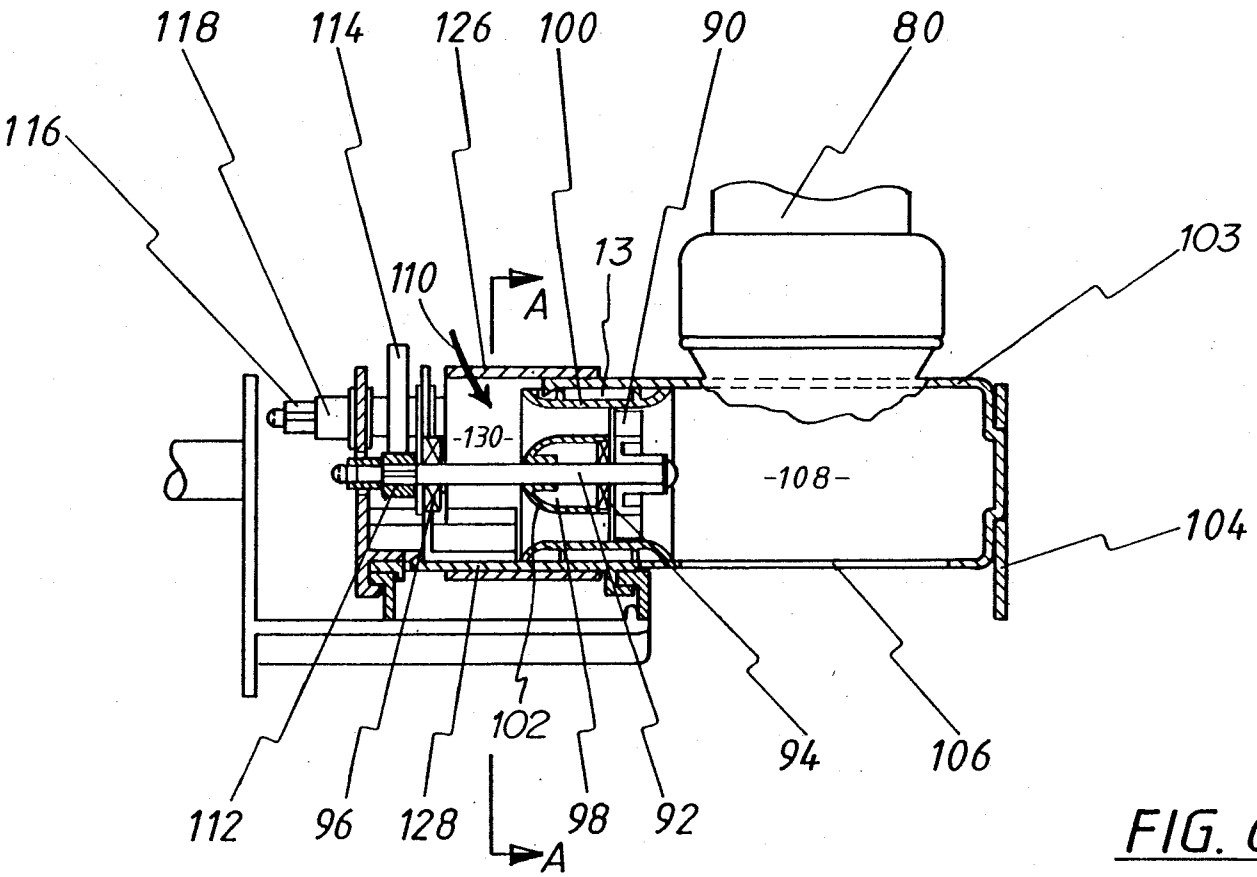
FIG. 6 shows a cross-sectional view through one form of motive means suitable for incorporation in apparatus according to the invention.
Figure 7:
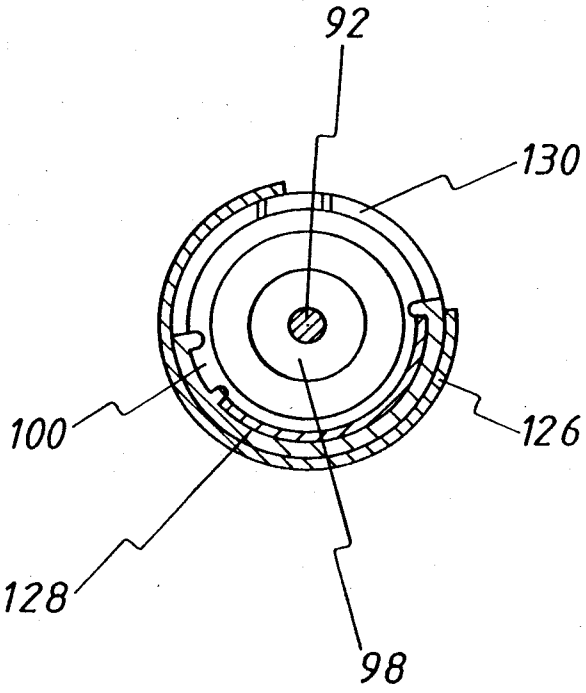
FIG. 7 shows a view along the line A—A in FIG. 6.

Referring now to FIG. 6 the motive means 13 is, as stated above, preferably an axial flow turbine of the Kaplan type and comprises a rotor 90 mounted on turbine shaft 92. The shaft 92 is, in turn, rotatably supported by bearings 94 and 96. A stator 98 is mounted on the upstream side of rotor 90 and comprises a turbine outer body 100 and central hub 102. We have found that a turbine having an outer body of 30 mm inside diameter and a hub diameter of 18 mm will rotate at speeds of 2500 to 3500 rpm for pump flowrates of 72 to 112 liters minute.

Fitting 80 projects from a cylindrical hub 103, one end of which is axially and rotatably engaged about the outlet end of the turbine 13. The opposite end of the hub 103 is rotatably supported in rib 104 projecting from the interior surface of the chassis base 40. Slot 106 is provided in the periphery of the hub 103 to place the interior 108 thereof in communication with inlet 9. The axis of hub 103 and the axis of turbine shaft 92 lie on the axis 19. Thus the stability of the apparatus is effected to the least extent by restraining forces applied though suction hose 12 attached to the fitting 80.

Obviously upon suction being applied to fitting 80, water is drawn through inlet 9 and into the interior 108 of the fitting through slot 106. Simultaneously water is drawn through inlet 10 along direction of arrow 110, through the turbine 13 and thence into hub 103.

The turbine shaft 92 has a spur gear 112 mounted thereon which transmits drive to gear 114 mounted on intermediate shaft 116 for rotation therewith. Further gear 118 of lesser diameter than gear 114, is also mounted on shaft 116 for rotation therewith and transmits drive to gear 120 mounted on main drive shaft 27.

Typically gears 112 and 118 are provided with 12 teeth while gears 114 and 120 are provided with 50 teeth. Thus there is an overall reduction in speed of 20.25:1 between the turbine shaft 92 and the main drive shaft 27.

It will be appreciated that the speed of the rotor 13 depends essentially on the flowrate of the pump to which hose 12 is attached and, in any given situation, this flowrate is relatively constant. However, the resulting speed of the apparatus may not be as desired and it is thus desirable that some means be included in the apparatus to vary the speed thereof to some extent. This control means is preferably provided in the form of throttling means to throttle the water flowrate through the turbine 13. The throttling means, in the form shown, comprises a semi cylindrical shroud member 126 rotatably mounted over turbine inlet housing 128 and selectively positionable between inlet 10 and the inlet chamber 130 of the turbine to vary the flowrate through the turbine.

Referring again to FIG. 4, the distal ends of the drive shaft 27 project beyond the sides of the chassis to drivingly engage the main drive wheels 15 and 17. As can be seen spur gears 130 are provided on both ends of the drive shaft 27 and these gears 130 drivingly engage planet gear surfaces 132 forming part of annular drive rings 134, the ring 134 defining part of the inner edge of the wheels 15 and 17. As an alternative to gears 130 and 132 frictional drive surfaces could be provided on the drive shaft 27 and annular drive rings 134 respectively.

It will be appreciated that the diameter of the planetary surfaces 132 is considerably greater than that of the surfaces 130 and thus a further reduction in speed is achieved as drive is transmitted to the wheels 15 and 17 by the drive shaft 27.

In order to cover the entire surface of the vessel being cleaned without substantial human intervention, it is necessary that the apparatus, itself, generate some degree of random movement. We have achieved this by arranging for the drive wheel 17 to be rotated in a reverse direction, intermittently, by reversing means 31.

Reversing means 31 achieves the reverse rotation by displacing end 140 of the drive shaft 27 so that gear or drive surface 130 thereon engages a further planetary surface 142, on the annular drive ring 134 forming part of the wheel 17, which is on the opposite side of the axis of rotation of shaft 27 to the planetary surface 132. Both the displacement, and the intermittent nature thereof, are effected by the means 31.

More particularly drive shaft 27 comprises a section 150 and a section 152 connected through joint 154. Joint 154 is designed to accommodate some misalignment of the sections 150 and 152 although, having regard to the limited movement, and thus misalignment, the flexible joint 154 may not be necessary.

The two sections are supported in bearings 156 and 158 mounted directly on the chassis base 40 and in bearing 160 mounted on a subframe 170 which, in turn, is pivotally mounted on the chassis base. The pivot point is indicated by reference numberal 172 in FIG. 9.

Figure 8:
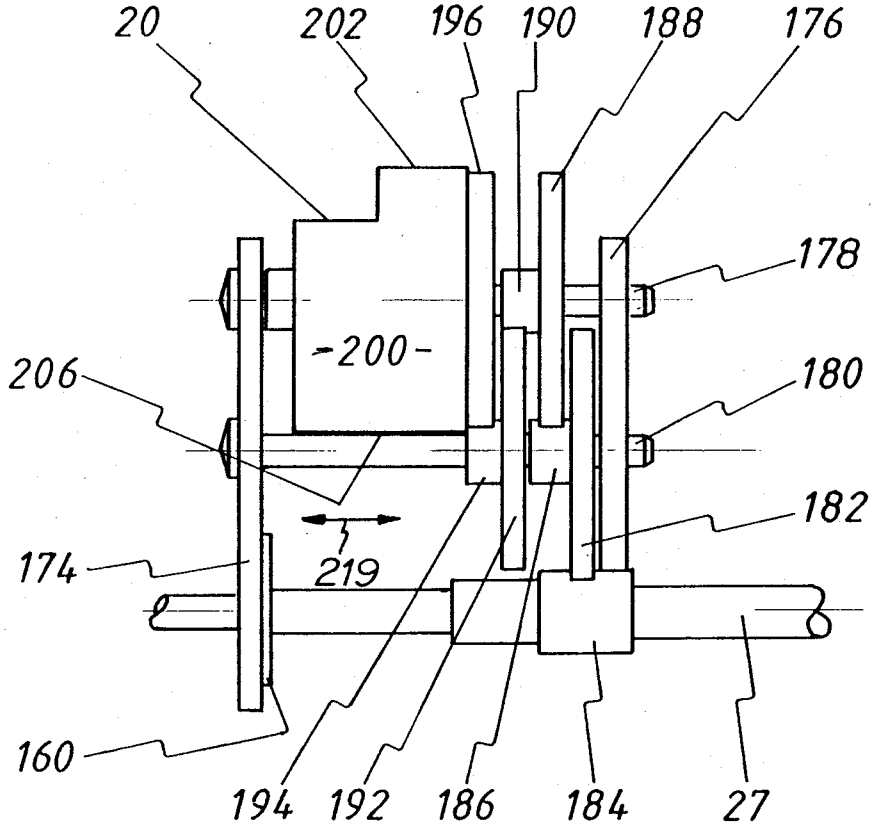
FIG. 8 shows a plan view of reversing means suitable for incorporation in apparatus according to the invention.

Turning now to FIG. 8, the subframe 170 includes a first pivotal side plate 174 and a second pivotal side plate 176. First and second shafts 178 and 180 respectively extend between the side plates 174 and 176 which, owing to this interconnection, pivot together. It will be noted from FIG. 8 that the axes of the shafts 178 and 180 are parallel.

A first gear 182 mounted for rotation on shaft 180 engages a spur gear 184 which is mounted for rotation with the drive shaft 27. Gear 186, of lesser diameter than gear 182 but mounted for rotation therewith, transfers drive to gear 188 which is mounted to rotation on shaft 178. Gear 190, of lesser diameter than gear 188 but mounted for rotation therewith, then imparts drive to further gear 192 which is mounted for rotation on shaft 180 but independently of gear combination 182/186. Gear 194 transfers the drive received by gear 192 to gear 196.

Mounted on the gear 196 for rotation therewith is a cam member 200. The cam member has two active surfaces 202 and 206 and a step 204 laterally adjacent surface 202. The surfaces 202 and 206 are equally spaced from the axis of shaft 178.

Figure 9:
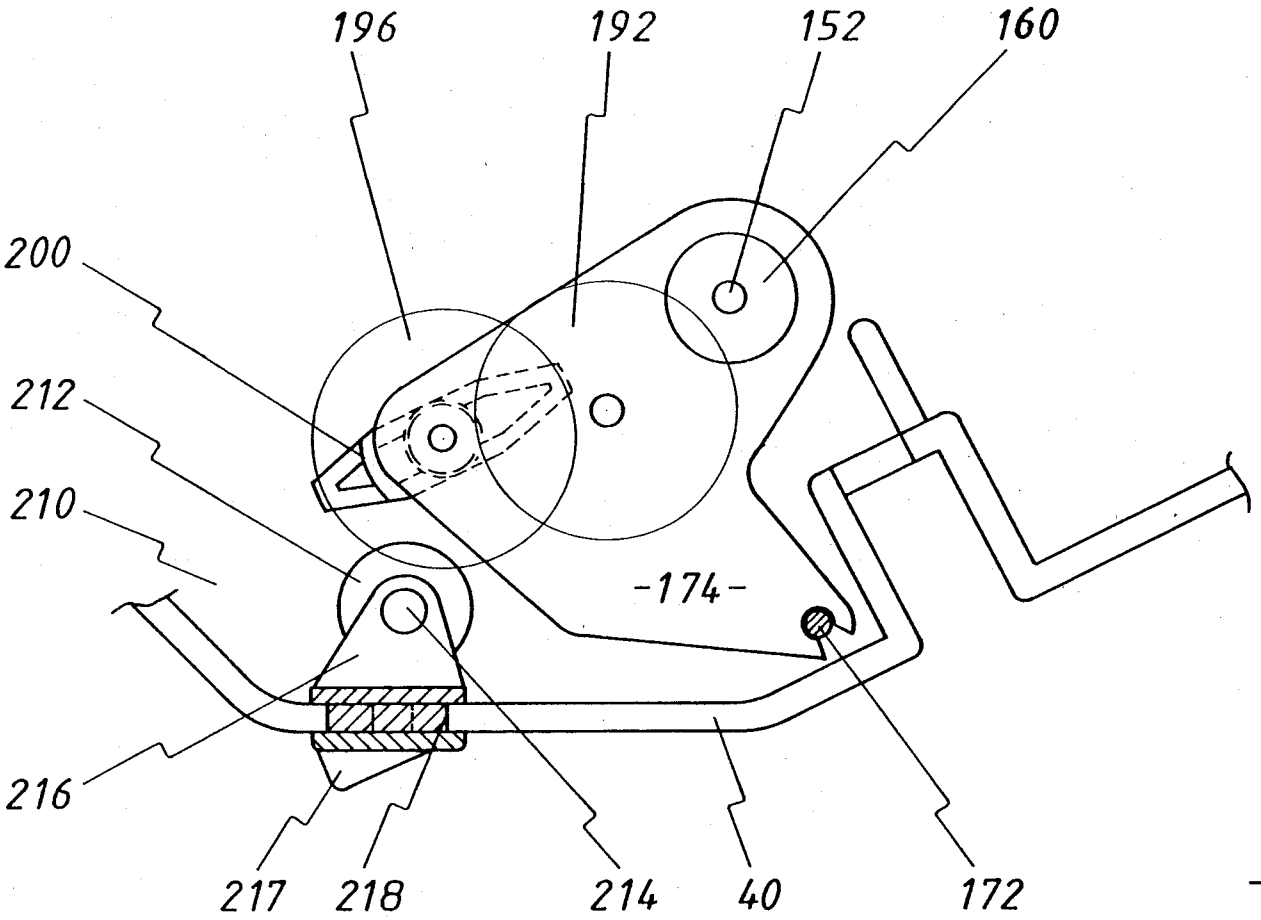
FIG. 9 shows a side elevational view of the reversing means shown in FIG. 8.

Referring now to FIG. 9 a cam follower 210 is mounted on the chassis base 40 beneath the cam member 200 in a position engageably thereby. As can be seen the cam follower 210 comprises a roller 212 mounted on shaft 214. Shaft 214 is, in turn, mounted on a forked base 216 which is engaged in a longitudinal slot 218 provided in the chassis base 40, the axis of the slot being arranged perpendicularly to the view as depicted in FIG. 9, the construction and arrangement being such that the mounting base 216 with rolls 212 mounted thereon can be displaced through knob 217 in a direction perpendicular to the view as depicted and in the direction indicated by arrow 219 in FIG. 8.

It will appreciated that as either of the cam surfaces 202, or 206 come into contact with roller 212 the subframe 170 is displaced about pivot 172 in a clock wise direction as viewed in FIG. 9. This effectively displaces end 140 of the drive shaft 27 rearwardly and thus biases drive surface 130 into contact with the outer planetary surface 142 of annular drive ring 134 attached to wheel 17. Obviously this causes the direction of rotation of the wheel 17 to be reversed and this reverse rotation is maintained until the appropriate cam surface disengages from the cam follower whereupon subframe 170 rotates in a counter clockwise direction under spring bias until drive surface 130 on the drive shaft 27 again engages with the inner drive surface on the wheel.

If the cam follower is positioned to engage cam surfaces 202 and 206 then the rotation of wheel 17 will be reversed twice for every revolution of the gear 196. If, however, the cam follower is positioned in register with step 204 and so as to avoid engagement by cam surface 202 then it will be engaged only by cam surface 206 once for every revolution of the gear 196.

The gears 182, 188, 192 and 196 typically have 50 teeth while the gears 186, 190 and 194 typically have 12 teeth. Gear 184 has 14 teeth. This results in an overall reduction in speed of 124:1 between the drive shaft 27 and the gear 196. Depending on the position of the cam follower 210 the rotation of wheel 17 can be reversed either once every 62 revolutions of the main drive shaft 27 or once every 124 revolutions.

It will be appreciated that by intermittently causing counter rotation of one of the drive wheels the apparatus will intermittently turn, the degree of turn being determined by the profile of the cam surfaces, and will thus move about in a somewhat haphazard manner over the surface of the vessel. The profile of the cam surfaces may be set to cause the apparatus to turn through 270° during each reversing cycle. Combined with the ability of the vessel to displace itself over vertical walls and combined with the control means which causes the apparatus to fall back into the interior of the pool when reaching the water surface, an effective coverage of the wetted pool surfaces is achieved.

Figure 4:
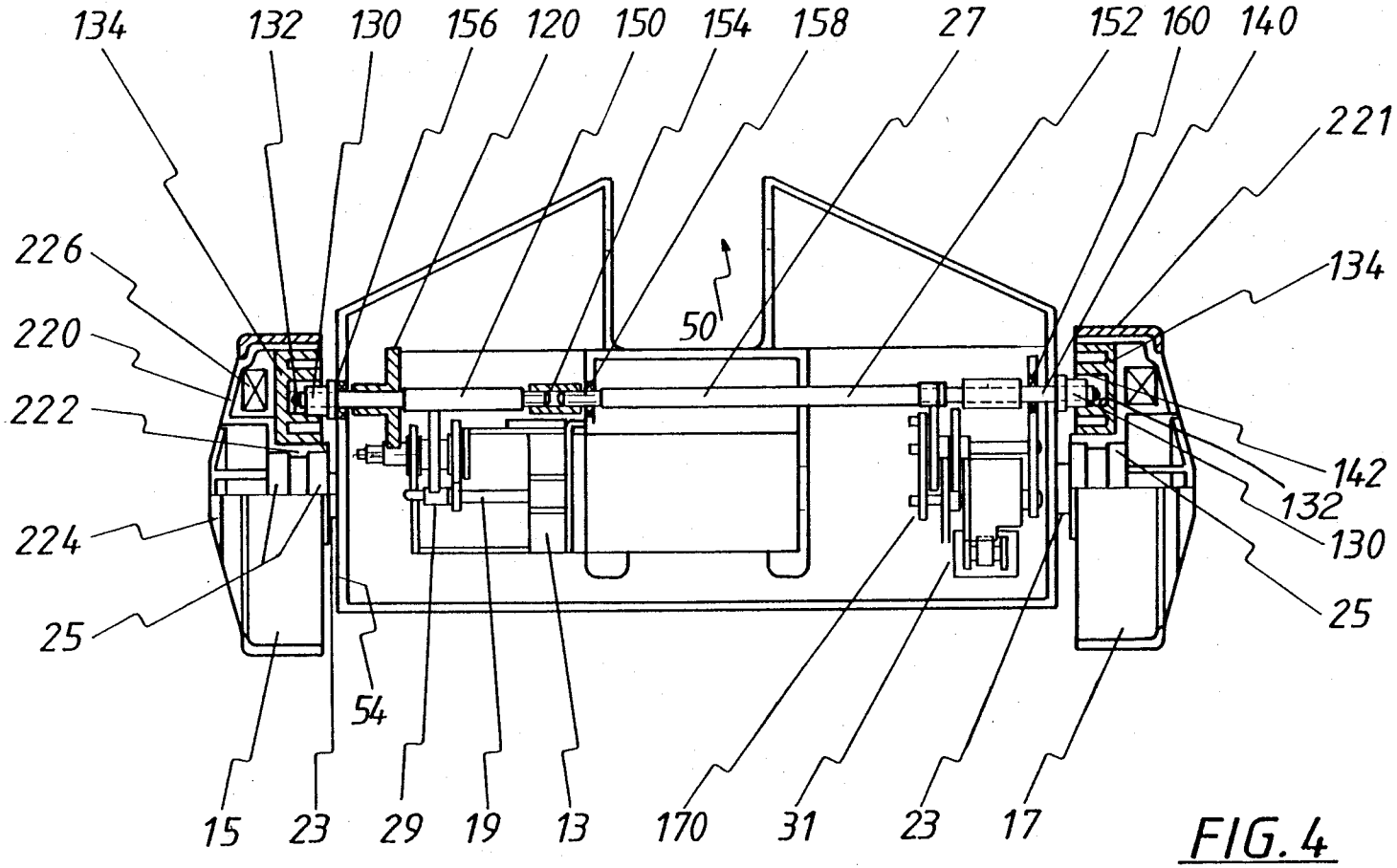
FIG. 4 shows a schematic plan view of the apparatus shown in FIG. 2 but with the top cover removed to show certain of the functional elements.

As can be seen from FIG. 4 the annular drive rings 134 of the wheels 15 and 17 are mounted on the interior of a moulded wheel rim section 220, the moulding 220 having a central hub section 222 which mounts bearings 25 and serving to mount a rubber tread 221. Hub caps 224 engage in the ends of the dead axles 23 to present smooth, obstruction free surfaces to the wheels 15 and 17.

Weights 226 may be placed in the wheels to counter the natural bouyancy of the chassis components. In use hose 12 connected to the outlet fitting 80 is engaged with the suction side of a swimming pool filter pump and the apparatus placed in the water whereupon gravity ensures that the apparatus falls to the base of the swimming pool or vessel. The suction applied at the outlet 11 draws water in through the inlets 9 and 10, the water drawn through inlet 10 passing through the turbine 30 to operate the same. The turbine rotation is transferred to the main drive shaft 27 through the reduction gear train 29 and is subsequently transferred to the drive wheels 15 and 17 through interengagement of drive surfaces 130 and 132.

The rotation of drive wheels 15 and 17 in a simultaneous manner causes the apparatus to be displaced over the surfaces of the vessel. When a vertical or upwardly sloping surface is encountered the guide wheel 33 lifts the front of the apparatus up until the nose wheel 21 and subsequently the drive wheels 15 and 17, engage the upward surface whereupon the apparatus is then displaced up this surface. Should the front of the apparatus be displaced above the water surface to expose the bouyancy chambers 70 and weight 72 dominates to cause the apparatus to rotate away from the surface and fall back into the interior of the vessel.

At given intervals the reversing means 31 operates to reverse the rotation of drive wheel 17 and thus change the direction of travel of the apparatus.

It will thus be appreciated that the present invention provides a form of cleaning of swimming pools and achieves its function substantially without the need for human intervention. The apparatus, at least in the preferred embodiment described, is believed to have the following advantages.

1. Since the water used to operate the drive turbine is drawn from the interior of the body of water and is separated from the water stream carrying dirt and debris, the possibility of the drive turbine becoming clogged is minimized.

2. Since the connection of the suction pipe is to a fitting rotatable about the wheel axis, the stability and operation of the apparatus is effected to a minimal extent as the angle between the suction line and the apparatus varies.

3. A very simple form of reversing mechanism is provided which operates automatically as the main drive shaft rotates in a constant direction and achieves the reverse function in a simple yet effective manner.

What I claim is:

1. Cleaning apparatus for cleaning the interior surface of a liquid containing vessel, said apparatus including a chassis; mobility means extending from said chassis to support said chassis on said interior surface, said mobility means being operable to effect movement of said chassis over said interior surface; a liquid outlet associated with said chassis and attachable to the suction side of a liquid pump; a first inlet associated with said chassis, said first inlet being positioned such that, when said apparatus is in its normal operative position on said mobility means, said first inlet faces towards and lies closely adjacent part of said interior surface; a second inlet associated with said chassis said second inlet being spaced from said first inlet, said first and second inlet being in communication with said outlet; filtering means covering said second inlet, for filtering debris from liquid flowing through said second inlet; and motive means mounted between said second inlet and said outlet, said motive means being actuated by liquid flow between said second inlet and said outlet and being operable to actuate said mobility means.

2. Apparatus as claimed in claim 1 wherein said first inlet and said second inlet are provided in spaced parallel planes and are aligned in the opposite sense.

3. Apparatus as claimed in claim 1 wherein said mobility means comprise a plurality of wheels.

4. Apparatus as claimed in claim 3 wherein said plurality of wheels include a pair of main drive wheels mounted on a common axis, and a third wheel mounted on an axis spaced from said common axis.

5. Apparatus as claimed in claim 4 wherein said third wheel is mounted midway between said main drive wheels on an axis lying parallel to and ahead of said, common axis.

6. Apparatus as claimed in claim 5 further including guide means to raise the leading edge of said apparatus upon engagement with an upwardly inclined surface.

7. Apparatus as claimed in claim 6 wherein said guide means includes a further wheel, the leading surface of said further wheel defining the leading edge of said apparatus, said further wheel being mounted above and ahead of said nose wheel.

8. Apparatus as claimed in claim 7 further including control means operable to, in use, cause said apparatus to disengage an upwardly inclined surface upon said control means being displaced above the liquid surface.

9. Apparatus as claimed in claim 8 wherein said control means comprises at least one sealed bouyancy chamber and a static mass to generate a gravitational force equivalent to the bouyancy generated by said chamber, when immersed.

10. Apparatus as claimed in claim 9 wherein a plurality of bouyancy chambers are provided, said chambers projecting to either side of said guide wheel and being symetrical about the axis of rotation of said guide wheel.

11. Apparatus as claimed in claim 4 wherein said outlet is included in a pivotal fitting.

12. Apparatus as claimed in claim 11 wherein said pivotal fitting pivots about said common axis.

13. Apparatus as claimed in claim 1 wherein said chassis comprises a base and a top cover inconnectable to define an enclosed housing, said first inlet being provided in said base and said second inlet being provided in said top cover.

14. Apparatus as claimed in claim 1 wherein said motive means comprises an axial flow turbine.

15. Apparatus as claimed in claim 7 wherein said axial flow turbine is of the Kaplan type.

16. Apparatus as claimed in claim 1 further including reverse means to intermittently counter rotate one of said drive wheels.

17. Apparatus as claimed in claim 16 wherein said drive wheels are driven by a drive shaft drivingly engaging planetary surfaces on said drive wheels, said reversing means including means to displace one end of said drive shaft so as to engage a planetary surface on one drive wheel located on the opposite side of the axis of rotation of said drive shaft to the planetary surface through which forward motion is effected.

18. Apparatus as claimed in claim 1 further including control means operable to, in use, cause said apparatus to disengage an upwardly inclined surface upon said control means being displaced above the liquid surface.

19. Apparatus as claimed in claim 18 wherein said control means comprises at least one sealed bouyancy chamber and a static mass to generate a gravitational force equivalent to the bouyancy generated by said chamber, when immersed.

* * * * *